US007654163B2

(12) United States Patent
Murase et al.

(10) Patent No.: US 7,654,163 B2
(45) Date of Patent: Feb. 2, 2010

(54) STARTER FOR VEHICLE ENGINE

(75) Inventors: Kazuaki Murase, Kounan (JP); Youichi Hasegawa, Kasugai (JP); Tomoya Imanishi, Kariya (JP)

(73) Assignee: Denso Corporation, Kariya (JP)

( * ) Notice: Subject to any disclaimer, the term of this patent is extended or adjusted under 35 U.S.C. 154(b) by 266 days.

(21) Appl. No.: 11/525,123

(22) Filed: Sep. 22, 2006

(65) Prior Publication Data

US 2007/0137325 A1 Jun. 21, 2007

(30) Foreign Application Priority Data

Sep. 26, 2005 (JP) ..... 2005-278649

(51) Int. Cl.
*F02N 15/00* (2006.01)

(52) U.S. Cl. ..... 74/7 A; 74/7 B

(58) Field of Classification Search ..... 74/6, 74/7 A, 7 B, 7 R

See application file for complete search history.

(56) References Cited

U.S. PATENT DOCUMENTS

| | | | | |
|---|---|---|---|---|
| 3,593,697 | A * | 7/1971 | Ciolli | 123/179.6 |
| 3,965,754 | A * | 6/1976 | Bowcott | 74/6 |
| 4,310,205 | A * | 1/1982 | Condon et al. | 384/620 |
| 4,579,010 | A * | 4/1986 | Colvin et al. | 74/7 A |
| 5,167,162 | A * | 12/1992 | Nagashima et al. | 74/7 A |
| 5,237,882 | A * | 8/1993 | Giometti | 74/7 A |
| 7,018,314 | B2 * | 3/2006 | Hasegawa et al. | 475/5 |
| 2007/0068288 | A1 * | 3/2007 | Hasegawa et al. | 74/7 A |

FOREIGN PATENT DOCUMENTS

| | | |
|---|---|---|
| JP | A-UM-S58-118260 | 8/1983 |
| JP | A-UM-S60-026285 | 2/1985 |
| JP | A 62-82365 | 5/1987 |
| JP | A 2002-213329 | 7/2002 |

OTHER PUBLICATIONS

Japanese Office Action dated Jun. 2, 2009 with English translation.

* cited by examiner

*Primary Examiner*—Richard W L Ridley
*Assistant Examiner*—Terence Boes
(74) *Attorney, Agent, or Firm*—Oliff & Berridge, PLC

(57) ABSTRACT

The starter for an engine of a vehicle includes a motor generating torque for starting the engine, an output shaft configured to move in an axial direction thereof by being pressed at a pressure-receiving portion thereof, and applied with the torque to rotate, and a lever switch configured to press the pressure-receiving portion of the output shaft at a pressure-applying portion thereof in accordance with an external command so that a pinion rotatably fixed to the output shaft engages with a gear of the engine to thereby start the engine. A protection member rotatable with respect to the pressure-receiving portion is provided between the pressure-receiving portion and the pressure-applying portion. The pressure-applying portion facing the pressure-receiving portion across from the protection member is formed with a groove to be filled by lubricant.

2 Claims, 7 Drawing Sheets

STARTER FOR VEHICLE ENGINE

CROSS-REFERENCE TO RELATED APPLICATION

This application is related to Japanese Patent Application No. 2005-278649 filed on Sep. 26, 2005, the contents of which are hereby incorporated by reference.

BACKGROUND OF THE INVENTION

1. Field of the Invention

The present invention relates to a starter having a shift lever for pushing out a pinion thereof, so that the pinion engages with a ring gear of a vehicle engine to start the engine.

2. Description of Related Art

It is known to provide such a starter with means for reducing wear of its shift lever as described, for example, in Japanese Patent Application Laid-open No. 2002-213329, and Japanese Utility Model Application No. 62-82365.

Japanese Patent Application Laid-open No. 2002-213329 discloses that a shift lever of a starter is formed with a hole at its end portion pressing an axially movable body, and this hole is filled by grease. The grease filled in the hole eases the friction between the end portion of the shift lever and the axially movable body, to reduce the wear of them. Japanese Utility Model Application Laid-open No. 62-82365 discloses that a shift lever of a starter is coated with a heat-resistant and wear-resistant material at its pinion pressing portion. This coating can reduce wear of the pinion pressing portion.

Incidentally, if such a starter enters the so called overrun state where a pinion of the starter is not pushed back by a shift lever after an engine is started, and accordingly the pinion continues to be engaged with a ring gear of the engine, a motor of the starter is caused to rotate at high speed by an engine torque. To avoid occurrence of such an overrun state, it is common that a one-way clutch is disposed between the motor and the pinion.

Here, in a case where the shift lever is configured to press a specific portion between the motor and the one-way clutch to push out the pinion, this specific portion can be prevented from being caused to rotate at a high speed while the starter is in the overrun state, because the one-way clutch blocks torque transmission from the engine to the starter. However, in a different case where the shift lever is configured to press a different specific portion between the one-way clutch and the pinion to push out the pinion, this portion is caused to rotate at high speed by the engine torque while the starter is in the overrun state. In the latter case, the friction between the shift lever and the specific portion becomes very large when there occurs the overrun state, and it cannot be reduced sufficiently by adopting the above described structure in which a hole is made in the end portion of the shift lever, and the hole is filled by grease. Accordingly, there has been a problem that the shift lever, which is generally made of a thermoplastic resin, may be worn and deformed by friction heat at its end portion.

Although the friction between the shift lever and the specific portion when there occurs the overrun state can be effectively suppressed by coating the end portion of the shift lever with a heat-resistant and wear-resistant material, there arises another problem in this case that the production cost of the shift lever becomes considerably high, because resin is very difficult to coat. It may occur that the shift lever is made of metal which is easy to coat. However, the production cost of the shift lever is still high in this case compared to the case of the shift lever being made of resin.

SUMMARY OF THE INVENTION

The present invention provides a starter for an engine of a vehicle, including:

a motor generating torque for starting the engine;

an output shaft configured to move in an axial direction thereof by being pressed at a pressure-receiving portion thereof, and applied with the torque to rotate; and a lever switch configured to press the pressure-receiving portion of the output shaft at a pressure-applying portion thereof in accordance with an external command so that a pinion rotatably fixed to the output shaft engages with a gear of the engine to thereby start the engine;

wherein a protection member rotatable with respect to the pressure-receiving portion is provided between the pressure-receiving portion and the pressure-applying portion, and the pressure-applying portion facing the pressure-receiving portion across from the protection member is formed with a groove to be filled by lubricant.

The protection member may be a washer inserted into the output shaft.

Means for preventing the washer from rotating with respect to the pressure-applying portion may be provided. This means may be constituted by a projection formed in the pressure-applying portion, and a cutoff portion formed in the washer for engagement with the projection.

The protection member may be constituted by a plurality of washers inserted into the output shaft so as to be situated between the pressure-receiving portion and the pressure-applying portion. In this case, the surfaces areas of the plurality of the washers may decrease in a direction from the pressure-applying portion to the pressure-receiving portion.

Means for preventing one of the washers which is closest to the pressure-applying portion from rotating with respect to the pressure applying portion may be provided. This means may be constituted by a projection formed in the pressure-applying portion, and a cutoff portion formed in the washer closest to the pressure-applying portion for engagement with the cut-off portion.

The protection member may be a washer integrally formed in the pressure-applying portion, and inserted into the output shaft.

In the starter of the present invention, friction between the washer as the protection member and the pressure-applying portion of the lever ring when there occurs the overrun state can be sufficiently suppressed, because the washer adheres to the pressure-applying portion by the action of viscosity of the lubricant, and accordingly it becomes difficult for the washer to move with respect to the pressure-applying portion.

Hence, in accordance with the present invention, wear and thermal deformation of the lever ring can be sufficiently suppressed without incurring high costs.

Other advantages and features of the invention will become apparent from the following description including the drawings and claims.

PREFERRED EMBODIMENTS OF THE INVENTION

First Embodiment

Figure 1:
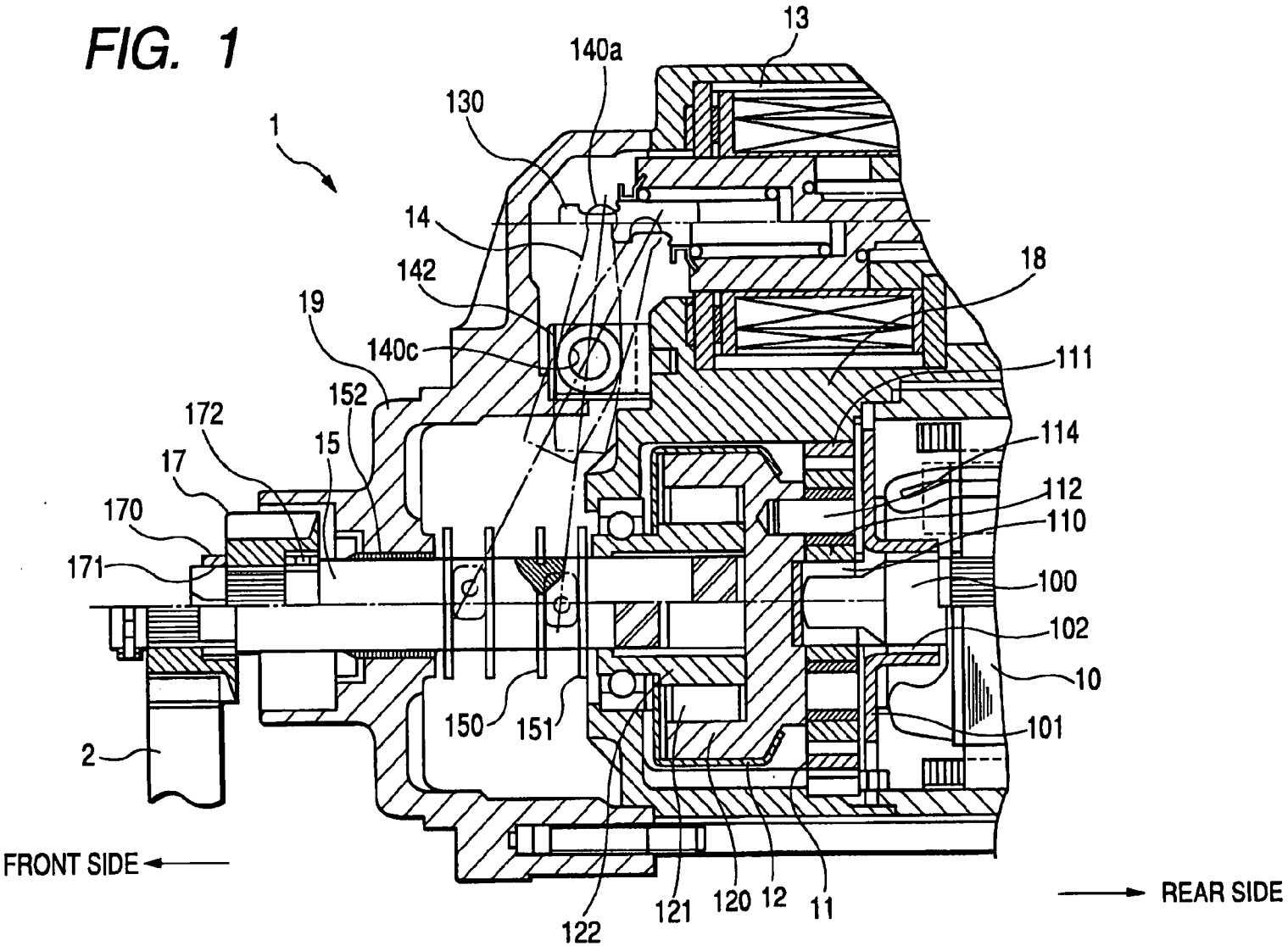
FIG. 1 is a partial cross-sectional view of a starter according to a first embodiment of the invention showing its major parts.

FIG. 1 is a partial cross-sectional view of a starter 1 according to a first embodiment of the invention showing its major parts.

As shown in this figure, the starter 1 includes a motor 10, a planet gear reduction device 11, a clutch 12, a magnet switch 13, a lever device (shift lever) 14, a clutch shaft (output shaft) 15, a washer 16 as a protection member (see FIG. 4), and a pinion 17. The motor 10, planet gear reduction device 11, and clutch 12 are housed in a frame 18. The magnet switch 18 is fixed on the top portion of the frame 18. The frame 18, lever device 14, clutch shaft 15, and washer 16 are housed in a housing 19. The pinion 17 is fixed to the front end portion of the clutch shaft 15 protruding frontward (leftward in FIG. 1) from the housing 19.

The motor 10 is for generating a torque to start a vehicle engine. A motor shaft 100 of the motor 10 is rotatably supported by a plate-like support member 101 fixed to the frame 18 through a bearing 102.

The planet gear reduction device 11 is for reducing the rotational speed of the motor shaft 100 of the motor 10. The planet gear reduction device 11 is constituted by a sun gear 110, an internal gear 111, and a plurality of planet gears 112. The sun gear 110 is formed in the front end portion of the motor shaft 100. The internal gear 111 is fixed to the frame 18. Each of the planet gears 112 is rotatably supported by a support shaft 114 through a bushing 113. The planet gears 112 meshing with the sun gear 110 and the internal gear 111 move around the sun gear 110 while rotating on their axes, to thereby reduce the rotational speed of the motor shaft 100.

The clutch 12, which is for transmitting torque from the planet gear reduction device 11 to the clutch shaft 15 when the rotational speed of the clutch shaft 15 is lower than that of the planet gear reduction device 11, is configured to idle for blocking the torque transmission between them when the rotational speed of the clutch shaft 15 exceeds that of the planet gear reduction device 11. The clutch 12 is constituted by a clutch outer ring 120, rollers 121, and a clutch inner ring 122. The clutch outer ring 120 is fixed to the planet gear reduction device 11 by the support shafts 114. The torque transmitted to the clutch outer ring 120 from the planet gear reduction device 11 is transmitted to the clutch inner ring 122 through the rollers 121.

The magnet switch 13 is for generating force to swing the lever device 14. The magnet switch 13 has a plunger 130 configured to reciprocate in the axial direction by magnetic force.

Figure 2:
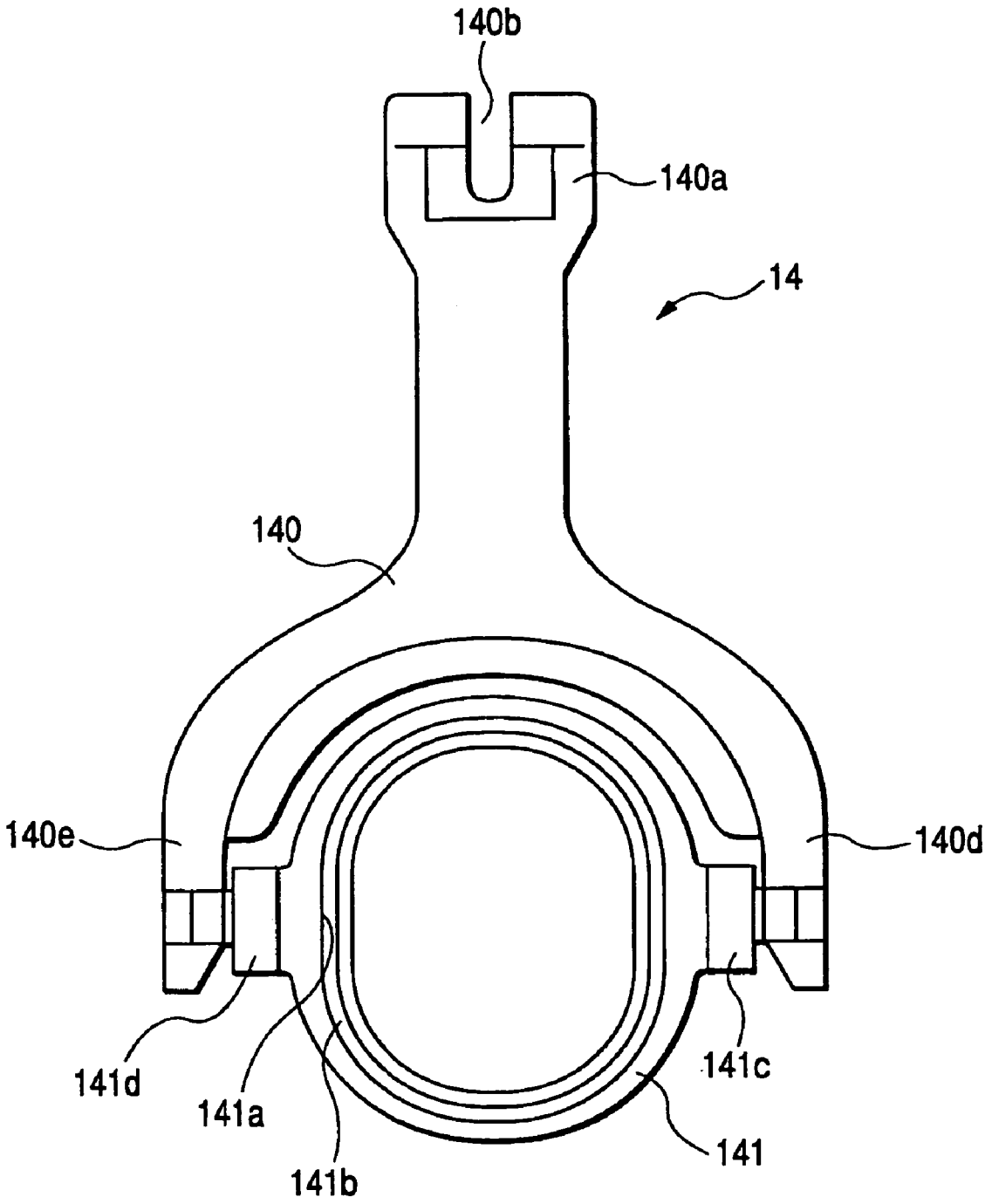
FIG. 2 is a front view of a lever device included in the starter show in FIG. 1.
Figure 3:
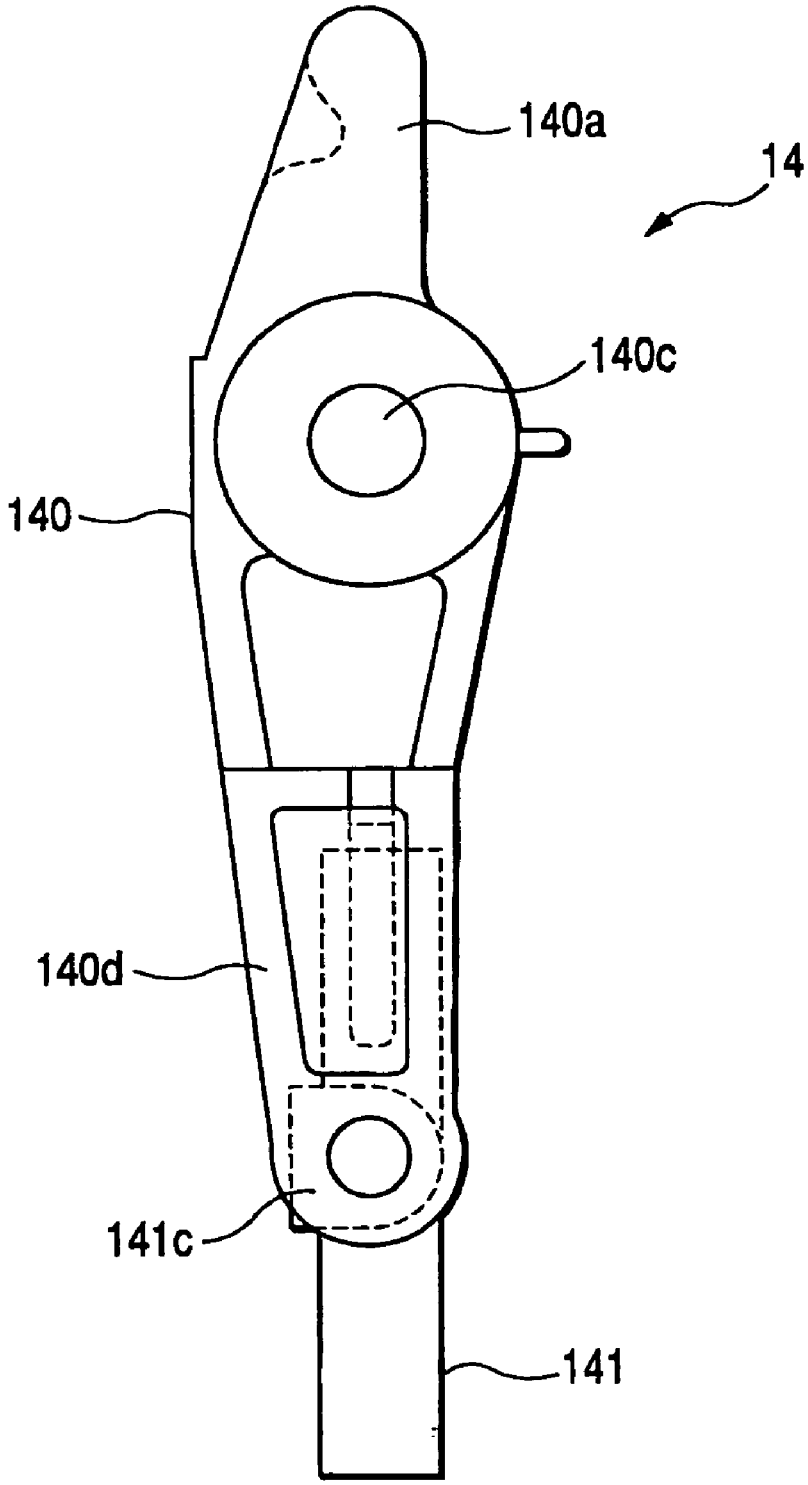
FIG. 3 is a side view of the lever device included in the starter shown in FIG. 1.

The lever device 14 is configured to swing by the force generated by the magnet switch 13 to thereby move the clutch shaft 15 in the axial direction. As shown in FIG. 2 and FIG. 3, the lever device 14 is constituted by a lever arm 140, and a lever ring 141. The lever arm 140, which may be made of resin, has a shape of inverted Y. The lever arm 140 is formed with a groove 140*b* at its head portion 140*a* for engagement with the plunger 130 of the magnet switch 13. The lever arm 140 is also formed with a through hole 140*c* at its side surface. The lever ring 141, which may be made of resin, has a shape of O. The lever ring 141 is formed with an O-shaped groove 141*a* at one surface thereof. The groove 141*a* is filled by grease 141*b* as lubricant. The lever ring 141 is also formed with projections 141*c*, 141*d* as lock portions for preventing the washer 16 from rotating. The projections 141*c*, 141*d* are shaped so as not to interfere with movements of members other than the washer 16. The lever ring 141 is turnably supported by leg portions 140*d*, 140*e* of the lever arm 140. As shown in FIG. 1, the lever device 14 is swingably supported by a lever holder 142 having a pin inserted into the through hole 140*c* of the lever device 14 and fixed to the frame 18. The head portion 140*a* of the lever device 14 is engaged with an end portion of the plunger 130 of the magnet switch 13.

The clutch shaft 15, which may be made of metal, is configured to move in the axial direction when pushed by the lever device 14, and to rotate by the torque transmitted from the motor 10 through the planet gear reduction device 11 and the clutch 12. The clutch shaft 15 is fitted to the clutch inner ring 122 by a helical spline at its rear end portion (the rightward end portion in FIG. 1). The clutch shaft 15 is reciprocatably and rotatably supported by the housing 19 through the bushing 152 at its front portion in such a state that front end of the clutch shaft 15 protrudes from the housing 19. The clutch shaft 15 is provided with stop rings 150 and 151 pressed by the lever device 14 at its center portion situated within the housing 19.

Figure 4A:
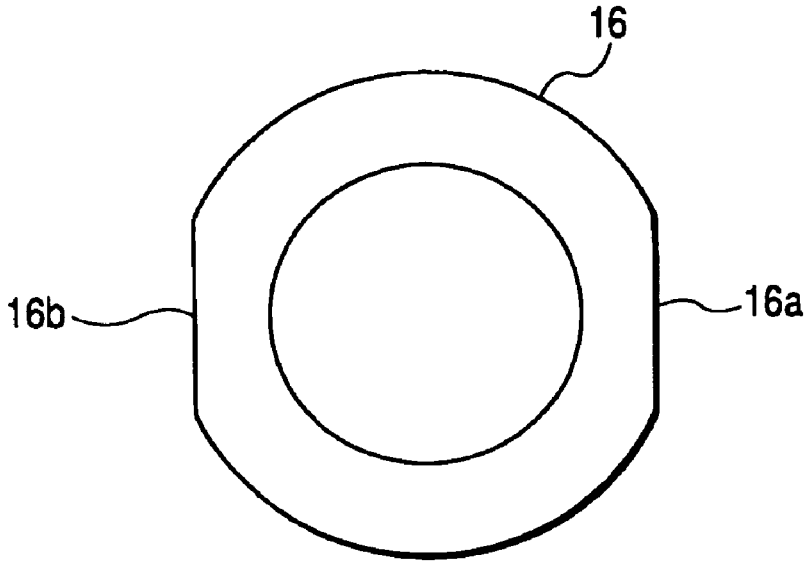
FIG. 4A is a front view of a washer inserted into a clutch shaft included in the starter shown in FIG. 1.
Figure 4B:
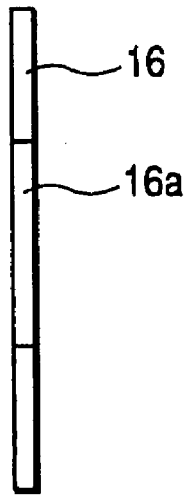
FIG. 4B is a side view of the washer inserted into the clutch shaft included in the starter shown in FIG. 1.

The washer 16, which is a ring-like metal member, is for reducing wear and thermal deformation of the lever device 14 due to friction with the stop rings 150, 151 of the clutch shaft 15. As shown in FIG. 4, the washer 16 is formed with cut-off portions 16*a*, 16*b* for engagement with the projections 141*c*, 141*d* of the lever ring 141.

Figure 6:
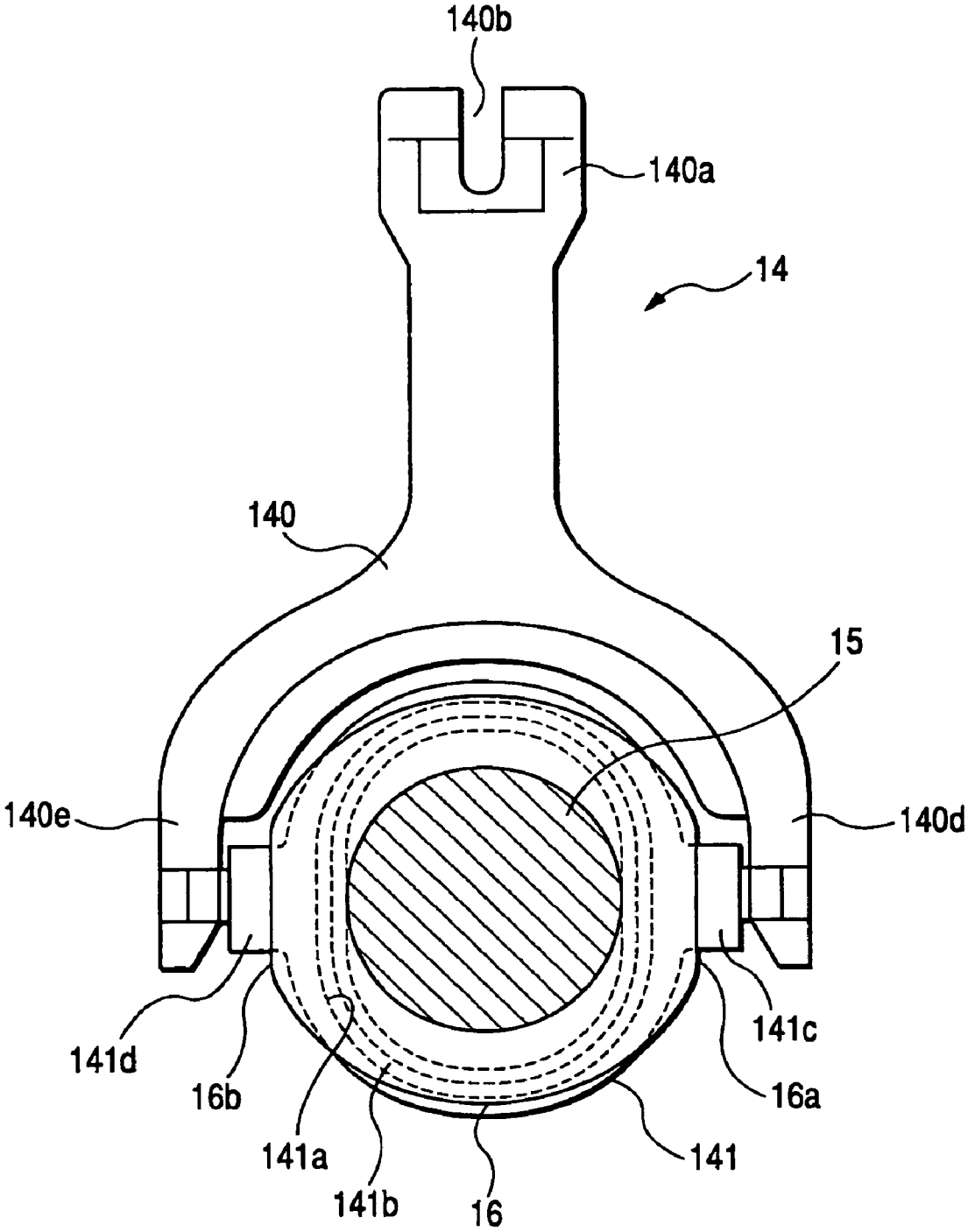
FIG. 6 is a cross-sectional view along a line A-A in FIG. 5.

Further details of the lever device 14, clutch shaft 15, and washer 16 are given below. The stop ring 150, which may be made of metal, is sustained by a snap ring 153 fixed to the clutch shaft 15. The stop ring 151, which may be made of metal, is sustained by a step portion 154 formed in the surface of the clutch shaft 15. The lever ring 141 inserted into the clutch shaft 15 is situated between the stop rings 150, 151 in such a state that the groove 141*a* filled by the grease 141*b* faces frontward. The washer 16 is situated between the lever ring 141 and the stop ring 150 so as to abut against the groove 141*a* side surface of the lever ring 141. As shown in FIG. 6, the cut-off portions 16*a*, 16*b* of the washer 16 are engaged with the projections 141*c*, 141*d* of the lever ring 141.

The pinion 17 is configured to move in the axial direction together with the clutch shaft 15 to mesh with the ring gear 2 of the engine, to thereby start the engine. As shown in FIG. 1, the pinion 17 is spline-fitted to the front end portion of the crank shaft 15 protruding from the housing 19. A stop collar 170 is fixed to the front end of the clutch shaft 15 by a snap ring 171 to restrict frontward movement of the pinion 17. The pinion 17 is biased toward the stop collar 170 by a pinion spring 172.

Next, the operation of the starter 1 having the above described structure is explained.

Figure 5:
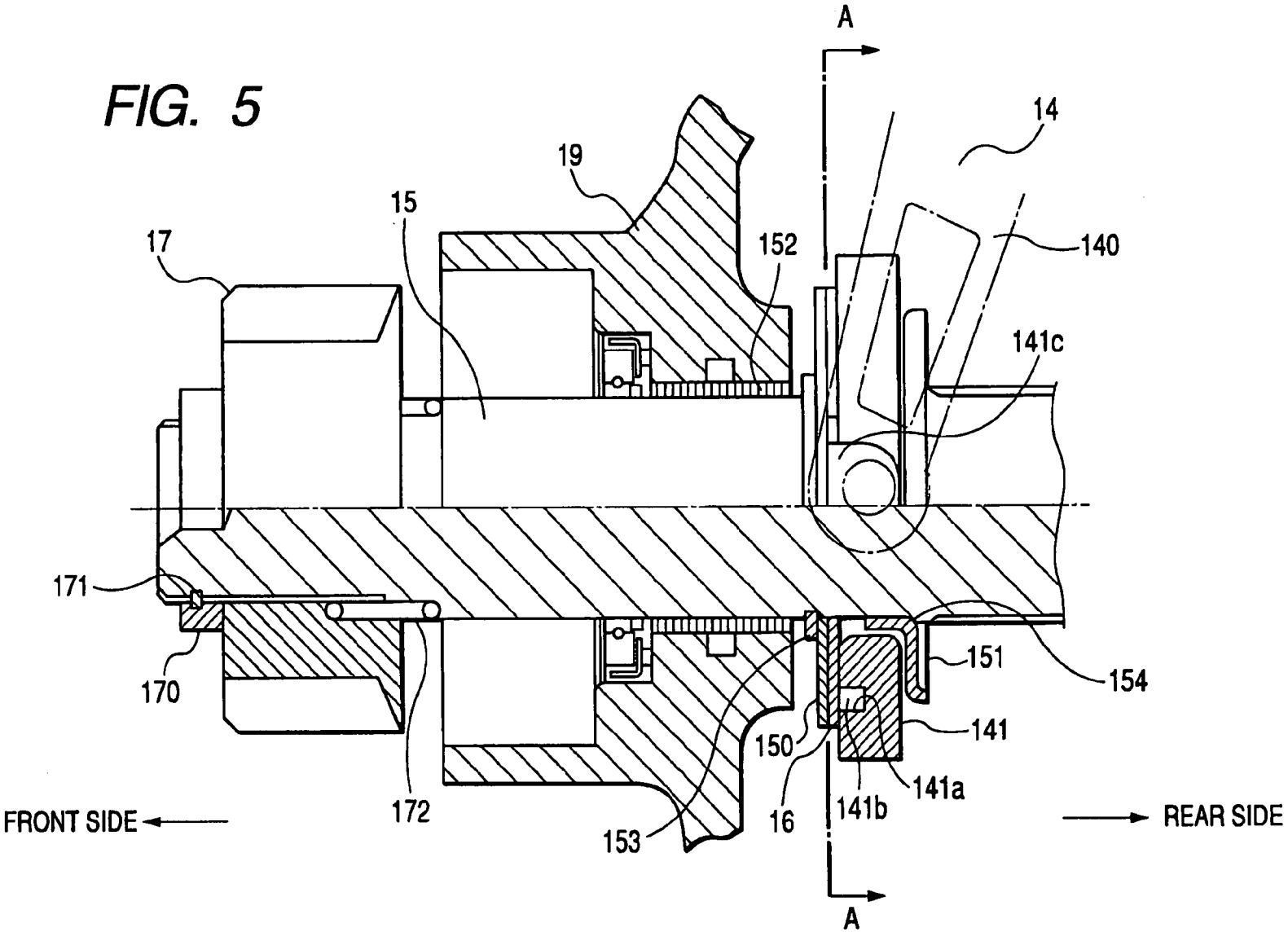
FIG. 5 is a partially enlarged cross-sectional view around the clutch shaft of the starter shown in FIG. 1.

When an ignition switch (not shown) is turned on, the magnet switch 13 is energized, and as a result the plunger 130 moves rearward. As the plunger 130 moves rearward, the lever device 14 swings to move the lever ring 141 frontward, as a result of which the lever ring 141 presses the stop ring 150 frontward through the washer 16 as shown in FIG. 5. As a result, the clutch shaft 15 moves frontward. When the clutch shaft 15 moves frontward, the pinion 17 fitted to the front end of the clutch shaft 15 engages with the ring gear 2 of the engine. At this time, a contact (not shown) of the magnet switch 13 is closed to supply the motor 10 with electric power so that the motor 10 generates torque. The torque generated by the motor 10 is transmitted to the clutch shaft 15 through the planet gear reduction device 11 reducing the rotational speed of the motor 10, and the clutch 12. This torque is further transmitted to the ring gear 2 through the pinion 17, and as a result, the engine starts.

When the ignition switch is turned off after the engine starts, the passage of current to the magnet switch 13 is interrupted, as a result of which the plunger 130 moves frontward. As the plunger 130 moves frontward, the lever device 14 swings to move the lever ring 141 rearward. In consequence, the lever ring 141 presses the stop ring 151 rearward, as a result of which the clutch shaft 15 moves rearward to disengage the pinion 17 from the ring gear 2 of the engine. At this time, the contact of the magnet switch 13 is opened, and accordingly the motor 10 stops. The stop of the motor causes the clutch shaft 15 and the pinion 17 to stop to complete the engine starting operation.

If the ignition switch continues to be turned on after the engine starts, the starter 1 enters the overrun state. In this state, the stop ring 150 may rotate together with the clutch shaft by the engine torque at a speed much faster (for example, five times faster) than its speed immediately before the engine starts. In this case, if the washer 16 is dragged by the stop ring 15, a large amount of friction heat may occur in the lever ring 141 due to friction between the washer 16 and the lever ring 141, as is the case of the conventional starter. However, according to this embodiment, the friction between the washer 16 and the lever ring 141 when there occurs the overrun state can be sufficiently suppressed, because the washer 16 adheres to the surface of the lever ring 141 by the action of viscosity of the grease 141*b*, and accordingly it becomes difficult for the washer 16 to move with respect to the surface of the lever ring 141. In addition, since the projections 141*c*, 141*d* of the lever ring 141 are engaged with the cut-off protons 16*a*, 16*b* of the washer 16, the rotation of the washer 16 with respect to the lever ring 141 is prevented reliably. Furthermore, temperature rise of the lever ring 141 due to friction between the stop ring 150, and the washer 16 can be suppressed by the action of the grease 141*b*.

As explained above, the above described first embodiment of the invention offers the following advantages. Wear and thermal deformation of the lever ring 141 can be sufficiently suppressed without incurring high costs, because of the structure of this embodiment in which the lever ring 141 is formed with the groove 141*a*, and this groove 141*a* is filled by the grease 141*b*. The combination of the projections 141*c*, 141*d* of the lever ring 141 and the cut-off portions 16*a*, 16*b* of the washer 16 prevents the washer 16 from rotating with respect to the lever ring 141 to thereby prevent occurrence of friction between the washer 16 and the lever ring 141. The washer 16 is adhered to the surface of the lever ring 141 by the viscosity of the grease 141*b*. Accordingly, wear of the lever ring 141 due to looseness of the washer 16 can be prevented.

Second Embodiment

Figure 7:
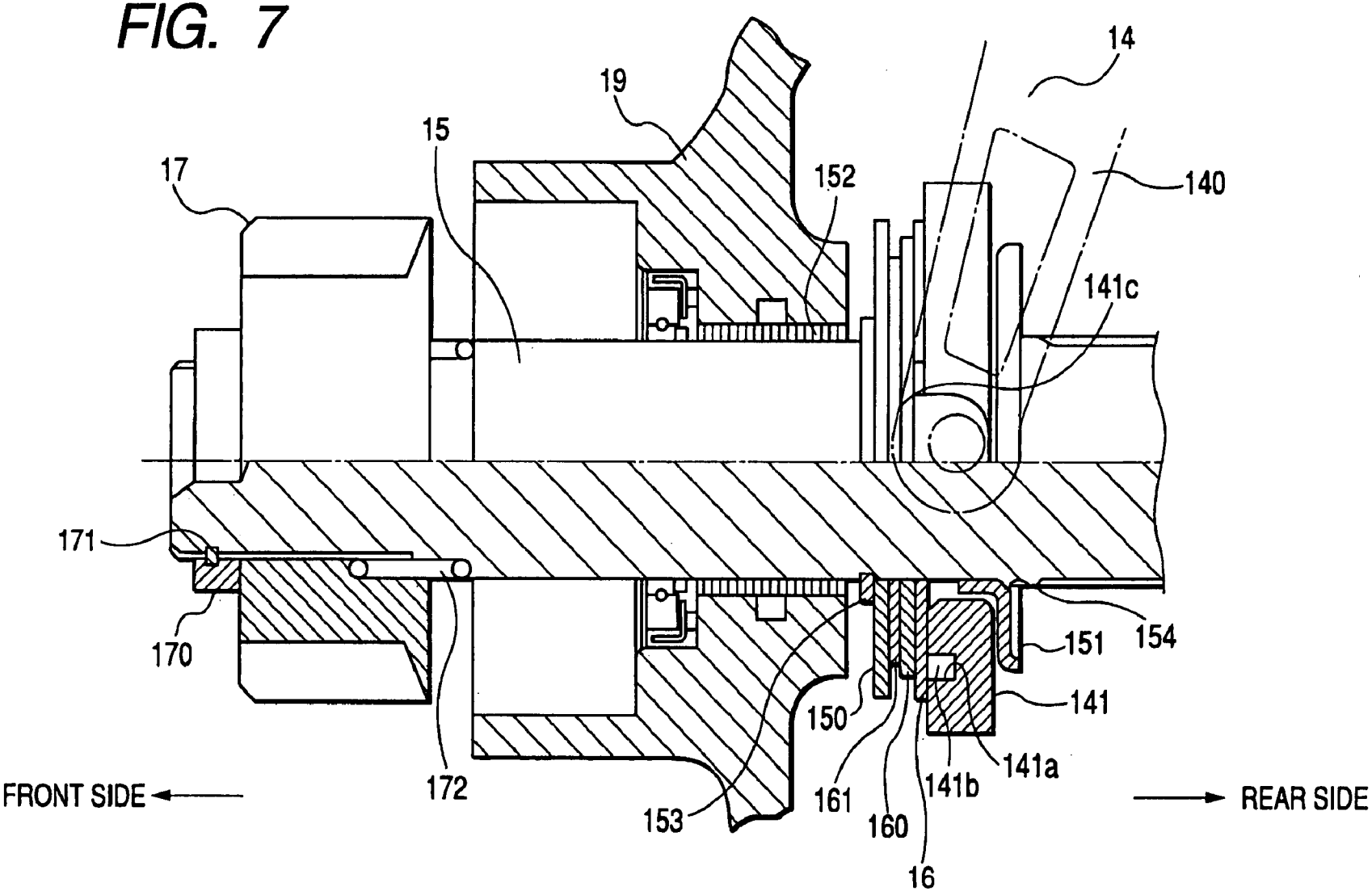
FIG. 7 is a partially enlarged cross-sectional view around the clutch shaft of a starter according to a second embodiment of the invention.

FIG. 7 is a partially enlarged cross-sectional view around the clutch shaft of a starter according to a second embodiment of the invention. The second embodiment differs from the first embodiment in that a plurality of washers (washers 16, 160, and 161) are inserted into the clutch shaft 15 in the second embodiment. In FIG. 7, elements identical to those shown in FIG. 1 are designated by the same reference characters.

As shown in FIG. 7, like the washer 16, the washers 160, 161 is a ring-like member made of metal for reducing the wear and thermal deformation of the lever device 14. The washer 160 is shaped to have a diameter smaller than that of the washer 16, so that the surface area of the washer 160 is smaller than that of the washer 16. The washer 161 is shaped to have a diameter smaller than that of the washer 160, so that the surface area of the washer 161 is smaller than that of the washer 160. The washer 160 adjoins the washer 16, and the washer 161 adjoins the stop ring 150. As shown in FIG. 7, the washer closer to the lever ring 141 has a larger surface area than the washer closer to the stop ring 150.

Next the operation of the starter of the second embodiment is explained.

Since the operation of the second embodiment is the same as the first embodiment until the engine is started, the following explanation is directed to the operation of the starter when it enters the overrun state. When the starter enters the overrun state, the stop ring 150 rotates together with the clutch shaft 15, and as a result friction heat occurs due to the friction between the stop ring 150 and the washer 161, the friction between the washer 161 and the washer 160, and the friction between the washer 160 and the washer 16.

In this embodiment, since the washer 16 closest to the lever ring 141 adheres to the surface of the lever ring 141 by the viscosity of the grease 141*b* filled in the groove 141*a*, it is difficult for the washer 16 to move with respect to the lever ring 141, and accordingly the friction between the washer 16 and the lever ring 141 can be sufficiently suppressed. In addition, since the friction occurs in a plurality of different places, it becomes possible to prevent the friction heat from concentrating on one place. Furthermore, the length of a heat transmission path from the friction heat source to the lever ring 141 is long by the provision of the plurality of the washers 16, 160, 161. For example, the friction heat occurred by the friction between the stop ring 150 and the washer 161 is transmitted to the lever ring 141 through the washers 161, 160, and 16. Hence, the amount of heat transmitted to the lever ring 141 can be reduced.

The second embodiment offers the following advantages.

Wear and thermal deformation of the lever ring 141 can be further sufficiently reduced because of the structure of this embodiment in which the lever ring 141 is formed with the groove 141*a* filled by the grease 141*b*, and the plurality of the washers 16, 160, 161 are provided between the lever ring 141 and the stop ring 150.

The washer closer to the lever ring 141 has a larger surface area than the washer closer to the stop ring 150. Since this improves heat dissipation characteristic around the lever ring 141, the thermal deformation of the lever ring 141 can be reduced.

It is a matter of course that various modifications can be made to the above described embodiments as described below.

Instead of forming the grooves in the surface of the lever ring 141 to be filled by the grease 141*b*, the washer 16 may be formed integrally with the resin-made lever ring 141. Also in this case, since the washer 16 can be prevented from rotating with respect to the lever ring 141, wear and thermal deformation of the lever ring 141 can be reduced as in the cases of the first and second embodiments.

The above explained preferred embodiments are exemplary of the invention of the present application which is described solely by the claims appended below. It should be understood that modifications of the preferred embodiments may be made as would occur to one of skill in the art.

What is claimed is:

1. A starter for an engine of a vehicle, comprising:

a motor generating torque for starting the engine;

an output shaft configured to move in an axial direction thereof by being pressed at a pressure-receiving portion of the output shaft, and applied with the torque to rotate;

wherein the pressure-receiving portion of the output shaft is disposed on a side of the output shaft that is closer to the vehicle than a clutch inner ring of a clutch; and a lever switch configured to press the pressure-receiving portion of the output shaft at a pressure-applying portion of the lever switch in accordance with an external command so that a pinion rotatably fixed to the output shaft engages with a gear of the engine to thereby start the engine;

wherein a protection member rotatable with respect to the pressure-receiving portion is provided between the pressure-receiving portion and the pressure-applying portion, the pressure-applying portion facing the pressure-receiving portion across from the protection member being formed with a groove to be filled by lubricant, and the protection member comprising a plurality of washers inserted onto the output shaft so as to be situated between the pressure-receiving portion and the pressure-applying portion.

2. The starter according to claim 1, further comprising means for preventing one of the plurality of washers that is closest to the pressure-applying portion from rotating with respect to the pressure applying portion.

* * * * *

UNITED STATES PATENT AND TRADEMARK OFFICE

CERTIFICATE OF CORRECTION

PATENT NO. : 7,654,163 B2
APPLICATION NO. : 11/525123
DATED : February 2, 2010
INVENTOR(S) : Murase et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 391 days.

Signed and Sealed this

Twenty-third Day of November, 2010

David J. Kappos

David J. Kappos
*Director of the United States Patent and Trademark Office*